US011986107B2

(12) United States Patent
Paupardin

(10) Patent No.: US 11,986,107 B2
(45) Date of Patent: May 21, 2024

(54) CELL AND METHOD FOR STORING A SET OF PRODUCTS, WITH CREATION OF AN AIR FLOW THROUGH THE SET OF PRODUCTS

(71) Applicant: FROMFROID, Isques (FR)

(72) Inventor: Thierry Paupardin, Jargeau (FR)

(73) Assignee: FROMFROID, Isques (FR)

( * ) Notice: Subject to any disclaimer, the term of this patent is extended or adjusted under 35 U.S.C. 154(b) by 844 days.

(21) Appl. No.: 16/978,878

(22) PCT Filed: Mar. 6, 2019

(86) PCT No.: PCT/EP2019/055515
§ 371 (c)(1),
(2) Date: Sep. 25, 2020

(87) PCT Pub. No.: WO2019/174985
PCT Pub. Date: Sep. 19, 2019

(65) Prior Publication Data

US 2021/0161312 A1 Jun. 3, 2021

(30) Foreign Application Priority Data

Mar. 12, 2018 (FR) ..... 1852108

(51) Int. Cl.
*A47F 3/00* (2006.01)
*B65D 88/74* (2006.01)
*F25D 17/00* (2006.01)

(52) U.S. Cl.
CPC ..... *A47F 3/001* (2013.01); *B65D 88/745* (2013.01); *B65D 88/747* (2013.01); *F25D 17/005* (2013.01)

(58) Field of Classification Search
CPC .... B65D 88/745; B65D 88/747; B65D 81/18; B65D 81/2038; F25D 17/005; F25D 17/045
See application file for complete search history.

(56) References Cited

U.S. PATENT DOCUMENTS 6,340,043 B1 * 1/2002 Paupardin ..... F25D 17/005 156/580
7,364,048 B2 4/2008 Cautereels et al.
(Continued)

FOREIGN PATENT DOCUMENTS

CN 104879977 A * 9/2015 ..... F25D 11/00
CN 104879977 A 9/2015
(Continued)

OTHER PUBLICATIONS

Int'l. Search Report for PCT/EP2019/055515, dated May 29, 2019.
(Continued)

*Primary Examiner* — Edelmira Bosques
*Assistant Examiner* — Michael James Giordano
(74) *Attorney, Agent, or Firm* — David D. Brush; Westman, Champlin & Koehler, P.A.

(57) ABSTRACT

A cell (1) for storing a set (2) of products (20) includes ventilation means (4) for creating a rear-to-front air flow (A) circulating in the housing (14) and at least one first sealing device (5 or 6) having a first flexible sealing element (50 or 60) that is inflatable in relation to one of the walls (10, 11, 12) of the cell and towards the inside of the housing (14) under the effect of an air pressure which is generated in the housing (14) by said air flow. The first sealing device (5 or 6) has at least one second sealing element (52 or 62) that can be actuated between an inactive configuration and an active configuration in which it exerts a mechanical pressure on part of the first flexible sealing element (50 or 60).

20 Claims, 15 Drawing Sheets

(56) References Cited

U.S. PATENT DOCUMENTS

| | | | |
|---|---|---|---|
| 9,731,889 | B2 | 8/2017 | Stanley et al. |
| 2010/0206875 | A1 | 8/2010 | Bratsch |

FOREIGN PATENT DOCUMENTS

| | | | | | |
|---|---|---|---|---|---|
| EP | 0273464 | A2 | | 7/1988 | |
| EP | 2947029 | A1 | * | 11/2015 | ..... B65D 88/744 |
| FR | 2767784 | A1 | | 3/1999 | |
| FR | 2871222 | A1 | | 12/2005 | |
| FR | 2938242 | A1 | | 5/2010 | |
| JP | 2001243531 | A | | 9/2001 | |
| RU | 2266031 | C1 | | 12/2005 | |
| RU | 2437816 | C2 | | 12/2011 | |
| RU | 2628889 | C1 | | 8/2017 | |
| WO | 9911141 | A1 | | 3/1999 | |
| WO | 2007129280 | A1 | | 11/2007 | |

OTHER PUBLICATIONS

English translation of the Written Opinion of the International Searching Authority dated May 29, 2019 for corresponding International Application No. PCT/EP2019/055515, filed Mar. 6, 2019.
Office action issued in corresponding Russian Patent Appln. No. 2020129031, dated May 23, 2022.
Indian Hearing Notice from Indian Intellectual Property Office dated Sep. 5, 2023 for corresponding Indian Application No. 202017036007.

* cited by examiner

CELL AND METHOD FOR STORING A SET OF PRODUCTS, WITH CREATION OF AN AIR FLOW THROUGH THE SET OF PRODUCTS

TECHNICAL FIELD

The present invention relates to the storage of a set of products in a storage cell comprising improved sealing means, with creation of an air flow circulating through the set of products, and in particular, but not exclusively, a reversible air flow. In particular, it can be used for the temporary storage of a set of food products, for example, but non-exhaustively, dairy or non-dairy food products, such as fermented yoghurts, farm-made yoghurts, other yoghurt products, dessert creams, cheeses, fruits, vegetables, and ready meals, with a modification or maintenance of the temperature and/or humidity of the products by means of said air flow.

PRIOR ART

In the agri-food sector, it is known to use storage cells, such as the one described in international patent application WO99/11141 or in French patent application FR2871222, for the temporary storage of a set of food products, and in particular dairy or non-dairy products, such as yoghurts, cheeses, etc., packaged and positioned on a storage medium, in particular of the pallet, rack or trolley type, with the creation of a flow of conditioned air through this set of products in order to adjust the temperature and/or humidity of the products.

This air flow, for example, may be a flow of cold air having a controlled temperature and, where appropriate, a controlled relative humidity, so as to allow cooling or low-temperature storage of the products, such as fermented yoghurts, other yoghurt products, and cheeses, where appropriate with controlled product humidity.

This air flow may also be a flow of hot air having a controlled temperature and, where appropriate, a controlled relative humidity, so as to allow heating of the products, where appropriate with controlled product humidity. This type of hot air flow is, for example, used to store fermentable products, such as farm-made yoghurts, by heating them so that they ferment during their time in the cell with a controlled fermentation period.

This air flow may also be an air flow at product temperature, where appropriate with controlled relative humidity, so as to enable the products to be maintained at a temperature for the duration of storage in the cell, where appropriate with controlled product humidity.

In international patent application WO99/11141, the air flow is created by means of at least one fan, which is positioned at the rear of the storage cell and which, in operation, makes it possible to blow an air flow from the rear to the front of the cell. In order to channel and force the air flow through the set of products positioned in the storage cell, seals on the top and on both sides of the set of products are created, respectively, by means of three sealing tarpaulins, which inflate under the action of the air pressures in the storage cell when the fan is operating and which, upon inflation, come to rest against the set of products so as to create a seal on the top and on both sides of the set of products. This seal forces the air flow to circulate from the rear to the front of the cell through the set of products.

French patent application FR2871222 describes a storage cell of the same type as that described in international patent application WO99/11141, but which has been improved by using a counterweight for the upper sealing tarpaulin, which counterweight is fixed to the rear end of the upper sealing tarpaulin, and by using a rotatable deflection bar supporting the rear part of the upper sealing tarpaulin, and a movable bar which is integral with the upper sealing tarpaulin, in particular by being incorporated in a sheath of the upper sealing tarpaulin. This movable bar pivots in rotation about a fixed horizontal axis. When the upper sealing tarpaulin inflates, it drives the movable bar forward from its rest position, shown in FIG. 1 of this publication, to an active position, which is shown in FIG. 2 of this publication and in which a fixed stop prevents the bar from rotating. The function of this movable bar is, in its active position shown in FIG. 2, to block the upper sealing tarpaulin to the front relative to the upper wall once said sealing tarpaulin is inflated. Thus, in its active position, this movable bar exerts a force on the upper sealing tarpaulin which is directed inwards and towards the rear of the storage cell and which enables the upper tarpaulin to be retained in relation to the upper wall.

The storage cells described in international patent application WO99/11141 and in French patent application FR2871222 make it possible, most of the time, to obtain a very good sealing and to channel the rear-to-front air flow in an efficient way through a set of products positioned in the storage cell.

However, the first disadvantage is that, as the seal is only ensured by the inflation of the sealing tarpaulins under the action of the rear-to-front air flow, there is a risk of a more or less significant loss of sealing, especially in the event of a fan malfunction, for example in the event of an accidental drop in the air flow rate of the fan or an unintentional shutdown of the fan. This first disadvantage is aggravated in the case of the storage cells described in French patent application FR2871222, due to the use of the counterweight at the rear portion of the upper sealing tarpaulin.

The storage cells described in international patent application WO99/11141 and in French patent application FR2871222 also have the second disadvantage of being unidirectional, i.e. of being designed and being able to operate only with an air flow circulating in the direction allowing the inflation of the sealing tarpaulins, in this case an air flow circulating in the storage cell from the rear to the front of the storage cell. However, in many cases it is desirable to be able to operate the storage cell also with a reverse air flow circulating from the front to the rear, and in particular, but not exclusively, to be able to operate the storage cell by alternating an air flow in one direction (for example from the rear to the front of the cell) with an air flow in the opposite direction (for example from the front to the rear of the cell).

Objective of the Invention

The main objective of the present invention is to propose a new storage cell, which is of the type described in international patent application WO99/11141 or in French patent application FR2871222, and which has been improved so as to overcome the first above-mentioned disadvantage and/or the second above-mentioned disadvantage.

SUMMARY OF THE INVENTION

According to the invention, the storage cell for at least one set of products and in particular for a set of products arranged on at least one storage medium, and more particularly on at least one storage medium of the pallet, trolley or rack type, has the following technical features.

The storage cell comprises two side walls facing each other and spaced apart from each other and an upper wall delimiting, with the two side walls, a housing for the set of products; said housing comprises, on the front side, an opening for the introduction and/or removal of the set of products; said cell also comprises ventilation means for creating a rear-to-front air flow (A) circulating in the housing from the rear to the front of the housing or for creating a front-to-rear air flow (B) circulating in the housing from the front to the rear of the housing, and at least one first sealing device comprising a first flexible sealing element that is inflatable in relation to one of the walls of the cell and towards the inside of the housing under the effect of an air pressure which is generated in the housing by said air flow (A or B) created by the ventilation means; said first sealing device comprises at least one second sealing element that can be actuated between an inactive configuration and an active configuration in which it exerts a mechanical pressure on part of the first flexible sealing element, said mechanical pressure being oriented towards the inside of the housing and allowing said first flexible sealing element to be distanced from said wall of the cell in relation to which said first flexible sealing element is inflatable; the cell comprises actuating means that allow the second sealing element to be actuated into its active configuration.

In contrast to the above-mentioned movable bar described in French patent application FR2871222, the second sealing element according to the invention does not have the function, in its active configuration, of blocking said first flexible sealing element towards the front, but on the contrary exerts mechanical pressure on part of the first flexible sealing element that is oriented towards the inside of the housing and in the direction opposite said cell wall in relation to which said first flexible sealing element is inflatable, and thus allows said first flexible sealing element to be distanced from said cell wall in relation to which said first flexible sealing element is inflatable. This mechanical pressure, which is oriented towards a set of products positioned in the housing of the cell, allows at least part of the corresponding first flexible sealing element to be applied or held against said set of products.

The invention also relates to an above-mentioned storage cell containing a set of products, as defined in claim 44, and in particular a set of products arranged on at least one storage medium, and more particularly on at least one storage medium of the pallet, trolley or rack type.

The invention also relates to the use of the above-mentioned storage cell for adjusting the temperature and/or humidity of at least one set of products, and more particularly of a set of products arranged on at least one storage support, and more particularly on at least one storage support of the pallet, trolley or rack type.

More particularly, the products are packaged or unpackaged food products, and more particularly food products selected from the following list: fermented yoghurts, farm-made yoghurts, other yoghurt products, dessert creams, cheeses, fruits, vegetables, and ready meals.

The invention also relates to a method for storing, and more particularly for adjusting the temperature and/or humidity of, at least one set of products by means of an above-mentioned storage cell.

BRIEF DESCRIPTION OF THE DRAWINGS

The features and advantages of the invention will become clearer on reading the following detailed description of a number of embodiments of the invention, which detailed description is given as a non-limiting and non-exhaustive example of the invention and with reference to the accompanying drawings, in which.

DETAILED DESCRIPTION

Figure 1:
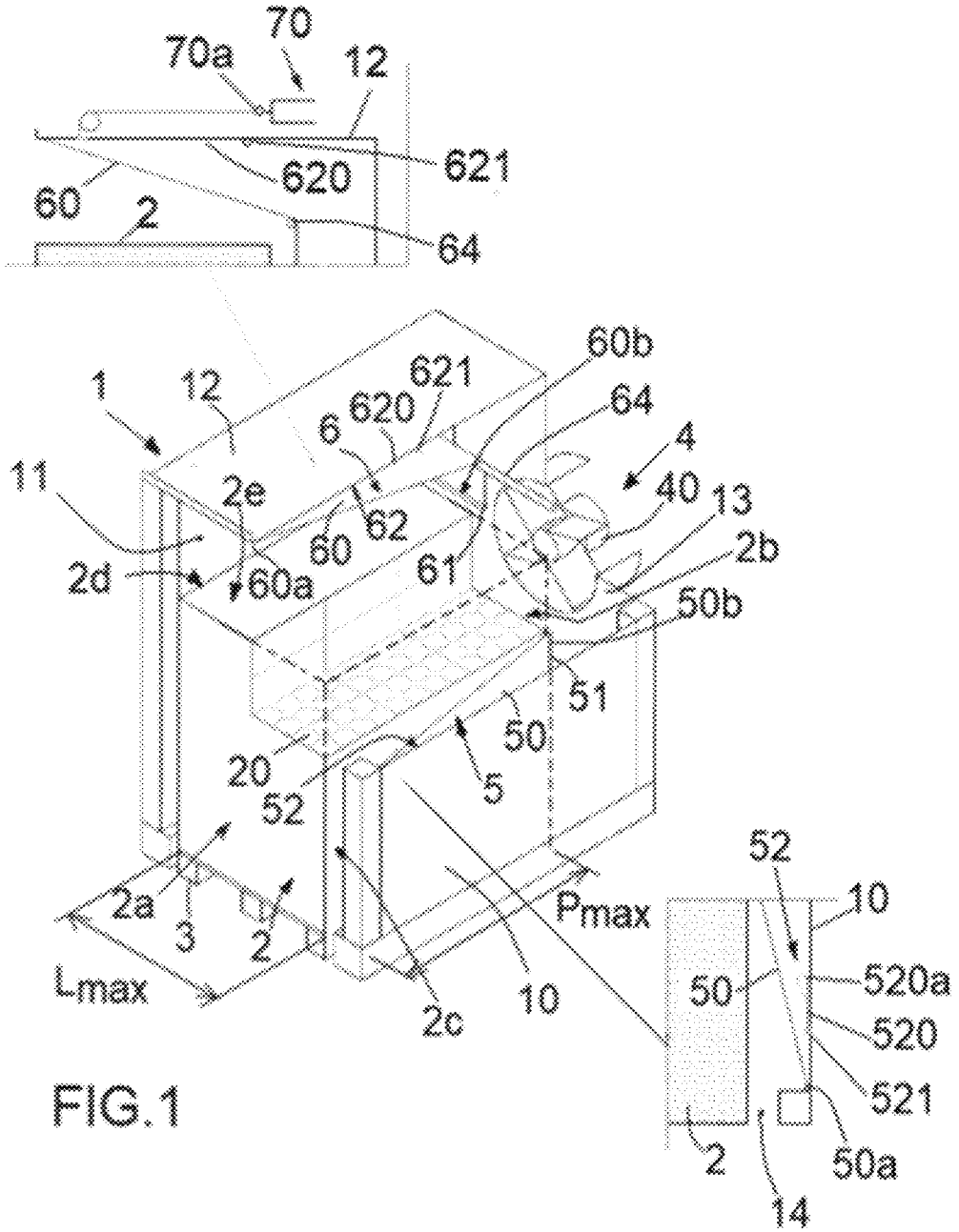
FIG. 1 is an isometric overview of a first embodiment of a standby storage cell in which a set of products on a pallet is positioned.

FIG. 1 shows a preferred embodiment of a storage cell 1 in which a set 2 of products 20 packaged in packages is positioned on a support 3 of the pallet type.

This storage cell 1 is particularly, but not exclusively, suitable for the storage of food products (dairy or non-dairy), such as fermented yoghurts, farm-made yoghurts, other yoghurt products, dessert creams, cheeses, fruits, vegetables, ready meals, etc., and can be used to adjust the temperature and/or humidity of the products 20.

This storage cell, however, can also be used with non-food products 20.

This set 2 of products 20 can be handled, for example, by means of a forklift truck, in order to be inserted into the storage cell 1 or removed from the storage cell 1.

Within the scope of the invention, the set 2 of products 20 may also be arranged on at least one storage medium, such as a trolley or rack.

In FIG. 1, this set 2 of products 20 is shown schematically, it being shown that at least the front 2*a* and rear 2*b* faces of this set 2 of products 20 may allow air to pass through.

This storage cell 1 comprises two side walls 10 and 11 opposite and spaced from each other and an upper wall 12 connecting the two side walls 10, 11 and delimiting, with the two side walls 10, 11, a housing 14. This housing 14 has an opening at the front, allowing in particular the introduction of the set 2 of products 20 into the storage cell and/or the removal of the set 2 of products 20 from the storage cell.

In FIG. 1, the side wall 10 and the upper wall 12 are cut so as to better visualize the inside of the cell; the upper part of the set 2 of products 20 in the form of an approximately rectangular parallelepiped is also cut (see the volume of removed products delimited by the dotted lines in FIG. 1) so as to visualize the products 20.

In this variant, the storage cell 1 also has a rear wall 13, it being noted that this rear wall 13 is optional and might not exist in another variant.

The storage cell has ventilation means 4 at the rear, in the form of at least one fan 40, which in operation creates a rear-to-front air flow A (FIG. 2) circulating from the rear to the front of the housing 14.

In this preferred embodiment, the ventilation means 4 also make it possible in operation to create, not simultaneously with the rear-to-front air flow A, a front-to-rear air flow B (FIG. 4) circulating from the front to the rear of the housing 14.

Preferably, the ventilation means 4 also include means (not shown) for adjusting the temperature and/or moisture content of the rear-to-front air flow A and, as applicable, the front-to-rear air flow B, before they pass through the cell.

This temperature and/or the humidity level of the rear-to-front air flow A and, as applicable, the front-to-rear air flow B, will depend on the nature of the products 20 stored in the cell 1 and the action (in particular cooling or heating or maintaining the temperature of the products 20) which is sought to be exerted on these products 20 by means of the rear-to-front air flow A and, as applicable, the front-to-rear air flow B.

In one variant, the rear-to-front air flow A and, as applicable, the front-to-rear air flow B can be obtained, for example, from the air in the room in which the storage cell is positioned; in this case the adjustment of the temperature and/or humidity of the rear-to-front air flow A and, as applicable, the front-to-rear air flow B can be obtained by adjusting the temperature and/or humidity of the air inside this room, for example by means of air conditioning using a refrigeration system or by means of a heater for heating the interior of the room.

Adjustment of the temperature and/or humidity of the rear-to-front air flow A and, as applicable, of the front-to-rear air flow B, may also be achieved by means of a refrigeration system or heating system that directly treats the room air flow before it passes into the storage cell. Alternatively, the rear-to-front air flow A and, as applicable, the front-to-rear air flow B, may originate from inside the room in which the storage cell is positioned or from outside this room, and the temperature and/or humidity may be adjusted by means of a refrigeration system or heating system, which directly treats the air flow before it passes into the storage cell. In some applications, the rear-to-front air flow A and, as applicable, the front-to-rear air flow B, can also be filtered, with a higher or lower filtration level, depending on the nature of the products 20 and the normative requirements.

The storage cell also has three sealing devices 5, 6, i.e. two side sealing devices 5 (in FIG. 1 only the right-hand side sealing device is visible) and one upper sealing device 6, the two side seals 5 being identical.

Each sealing device 5, 6 comprises a first flexible sealing element 50, 60 in the form of an airtight flexible sealing skirt which is capable, under the effect of an air pressure, of inflating in relation to the inner face of the corresponding wall 10, 11 or 12 of the cell and towards the inside of the housing 14.

This flexible sealing skirt 50, 60 is, in the example shown, formed of a blank of flexible, airtight material.

In particular, this flexible sealing skirt 50, 60 is, for example, formed by a single- or multi-layer airtight sealing tarpaulin or an airtight coated fabric.

The material or materials constituting the flexible sealing skirt, the structure of the flexible sealing skirt, and the method for producing this flexible sealing skirt are irrelevant to the invention.

The flexible side sealing skirt 50 of each side sealing device 5 is integral with the corresponding side wall 10 or 11 by being, more particularly, fixed at its front edge 50*a* to the front part of the inner face of the corresponding side wall 10 or 11, in the vicinity of the opening at the front of the housing 14.

The flexible side sealing skirt 50 of each side sealing device 5 is also fixed at its rear edge 50*b* to a vertical edge 51. This vertical edge 51 is fixed to the floor in the housing 14, spaced apart from the inner face of the side wall 10 or 11 and positioned laterally as close as possible to the location of the set 2 of products 20, i.e. as close as possible to the side face 2*c* or 2*d* of the set 2 of products 20 (FIG. 1).

Figure 8:
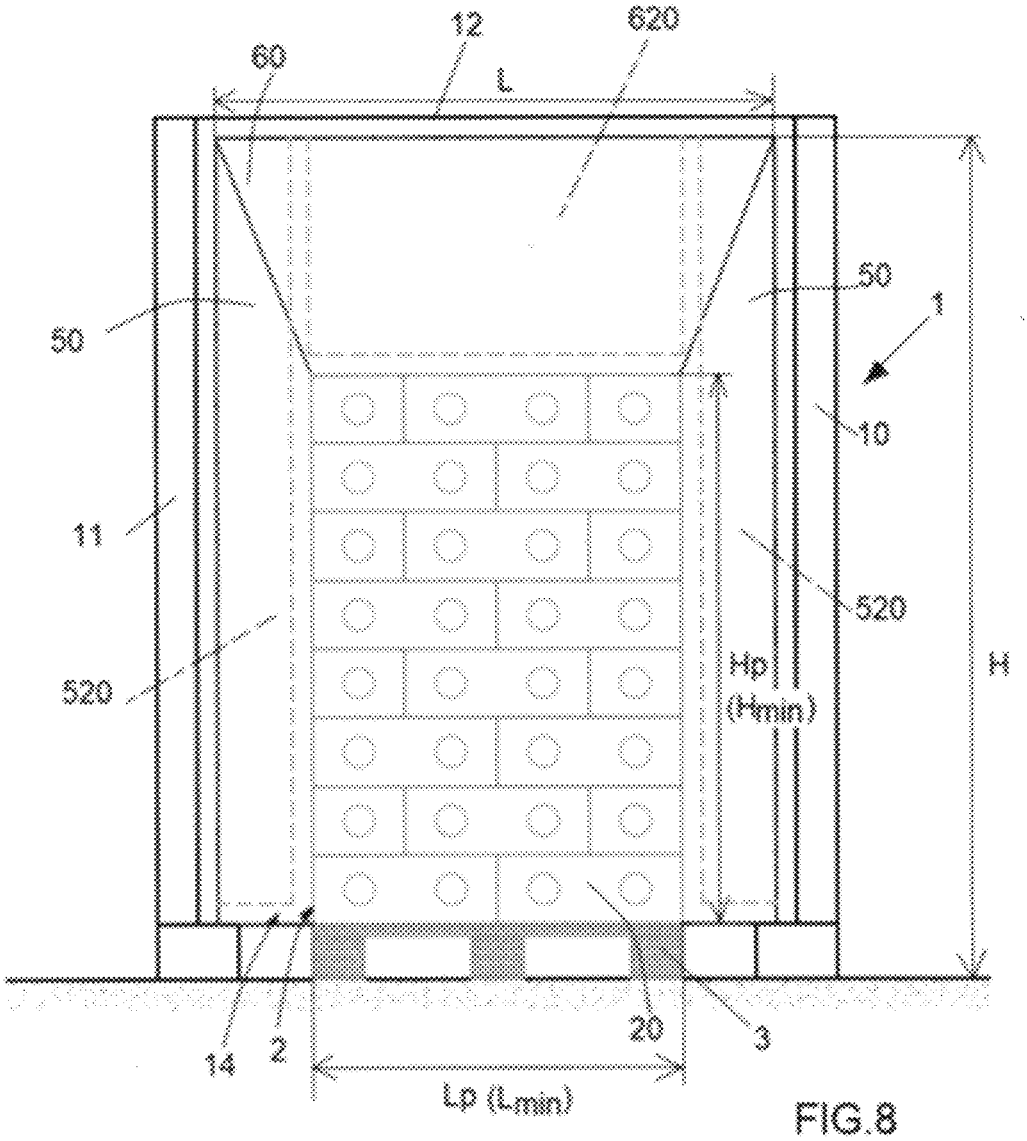
FIG. 8 is a schematic front view of the storage cell in FIG. 2 loaded with a set of products on a pallet of minimum height and minimum width, with the side and upper tarpaulins inflated and the sealing flaps in the active position.
Figure 9:
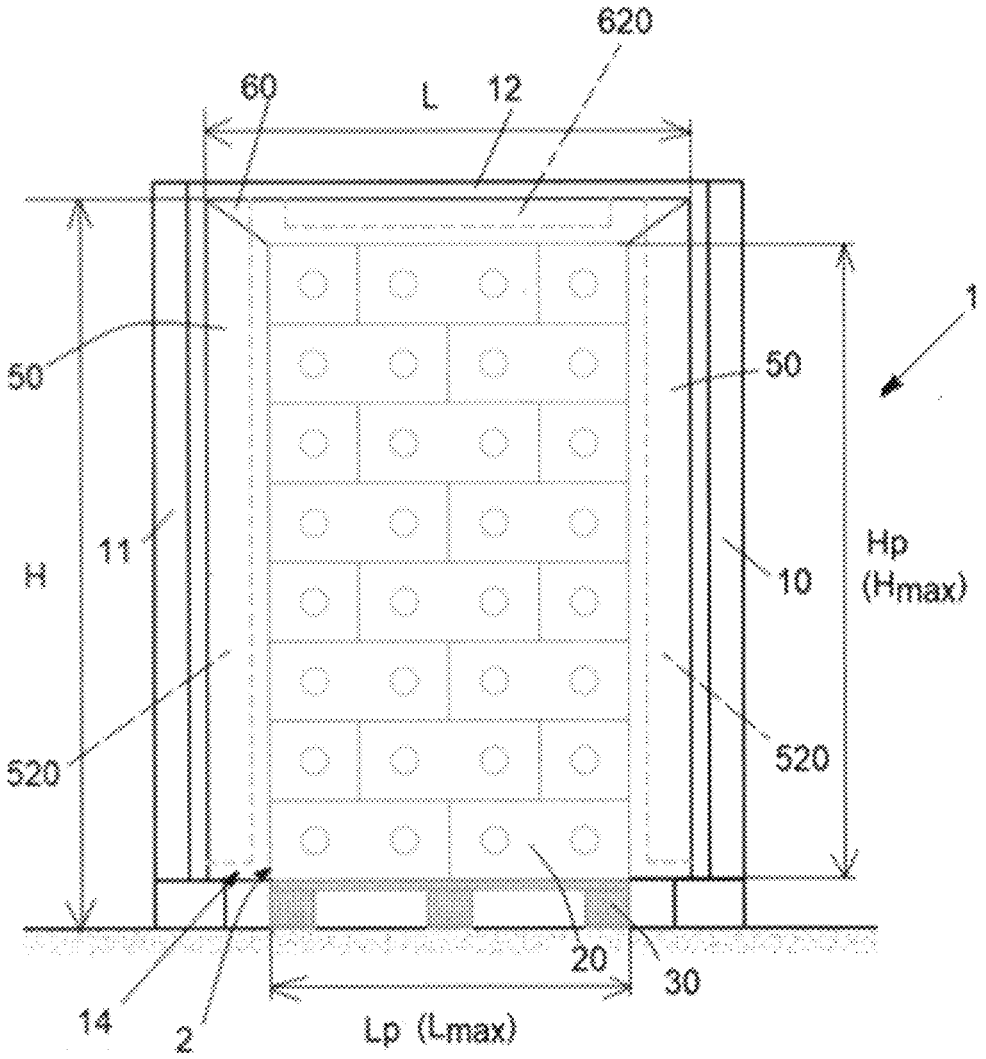
FIG. 9 is a schematic front view of the storage cell in FIG. 2 loaded with a set of products on a pallet of maximum height and maximum width, with the side and upper tarpaulins inflated and the sealing flaps in the active position.

The storage cell 1 is designed to receive a set 2 of products 20 on a support 3, said set 2 of products 20 having a height Hp between a predefined minimum height Hmin (FIG. 8) and a predefined maximum height Hmax (FIG. 9) and having a width Lp between a predefined minimum width Lmin (FIG. 8) and a predefined maximum width Lmax (FIG. 9).

The storage cell 1 is also designed to receive a set 2 of products 20 having a predefined maximum depth Pmax (FIG. 1).

In this variant, the distance between the two edges 51 of the two side sealing devices 5 defines the maximum width Lmax and the depth positioning of the edges 51 in the cell in relation to the loading or unloading opening at the front of the cell defines the maximum depth Pmax.

With reference to FIGS. 8 and 9, in this particular exemplary embodiment, the height and width of the housing 14 of the cell 1 are denoted as H and L, respectively.

Each flexible side sealing skirt 50 extends lengthwise in the depth of cell 1 over at least 50% of the maximum depth Pmax and preferably over at least the entire maximum depth Pmax.

Each flexible side sealing skirt 50 preferably extends in height over at least 50% of the height H of the housing 14 of the cell 1, and even more preferably over at least 75% of the height H of the housing 14 of the cell.

In operation, each flexible side sealing skirt 50 preferably extends at least over the full height Hp of the set 2 of products 20.

The use of such a side sealing skirt 50 is, furthermore, already known and described in particular in the applicant's international patent application WO99/11141, to which reference may be made.

The upper flexible sealing skirt 60 of the upper sealing device 6 is integral with the upper wall 12, more particularly by being fixed at its front edge 60*a* to the inner face of the upper wall 12. The rear part of the flexible upper sealing skirt 60 is supported by a horizontal deflection bar 64, which is mounted between the two side walls 10 and 11, preferably at the same depth in cell 1 as the two vertical edges 51. Preferably this deflection bar 64 is a rotating bar mounted so as to be freely rotatable. At the free rear edge 60*b* of this flexible upper sealing skirt 60 there is fixed a bar 61 which forms a counterweight allowing a return of the skirt 60 to the waiting position of FIG. 1, when the ventilation means 4 are not in operation.

Figure 2:
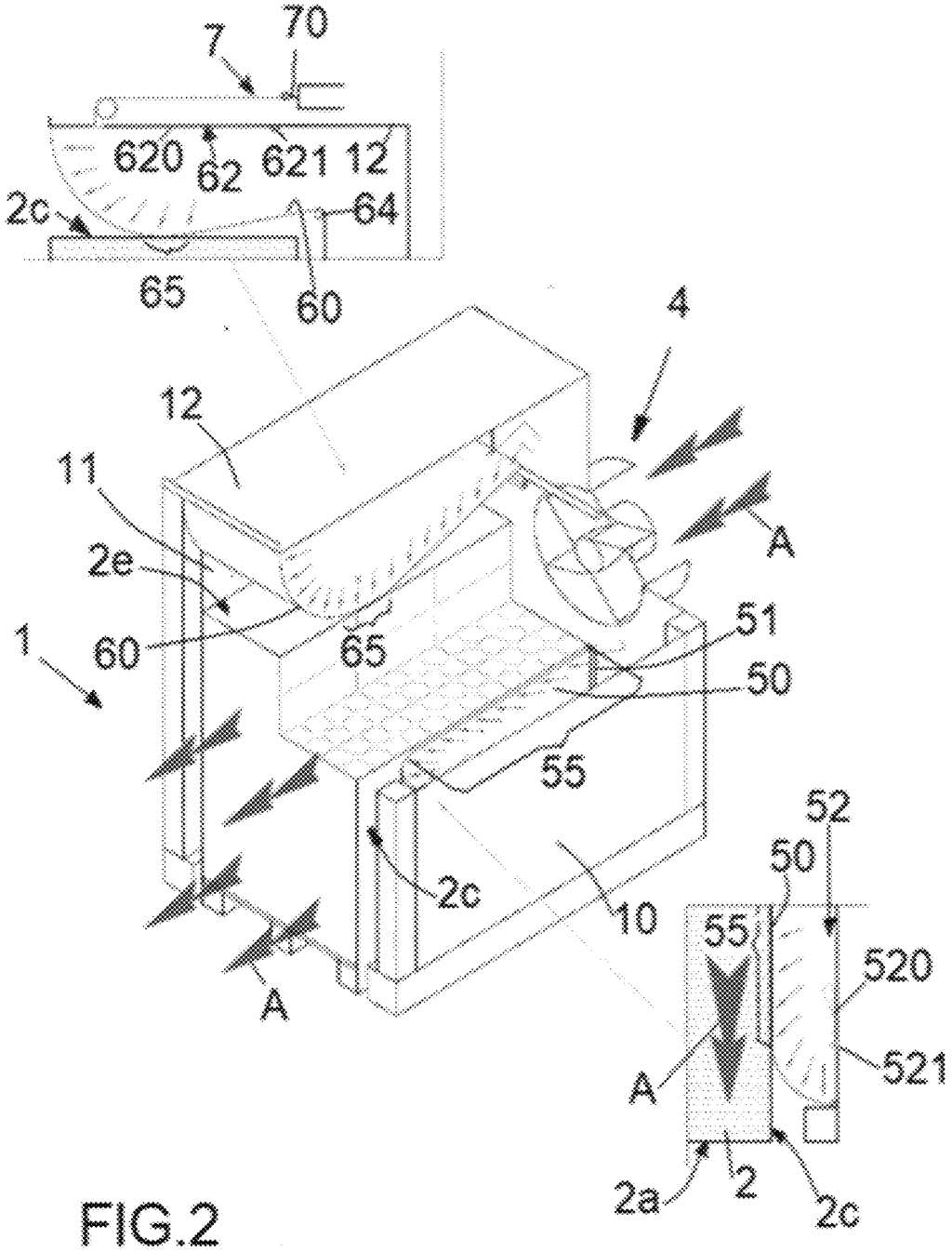
FIG. 2 shows the cell in FIG. 1 during a first phase of operation.

This flexible upper sealing skirt 60 extends lengthwise in the depth of the cell preferably over at least the entire maximum depth Pmax when inflated in sealing configuration with respect to the upper wall 12 (FIG. 2).

The upper flexible sealing skirt 60 extends preferably over at least 50% of the width L of the housing 14 of the cell 1, and even more preferably over at least 75% of the width L of the housing 14 of the cell.

In operation, each flexible side sealing skirt 50 extends in width preferably over at least 50% of the width Lp of the set 2 of products 20 and preferably over the entire width Lp of the set 2 of products 20.

The use of such an upper sealing skirt with counterweight 61 is, furthermore, already known and described in particular in the applicant's French patent application FR2871222, to which reference may be made.

Figure 3:
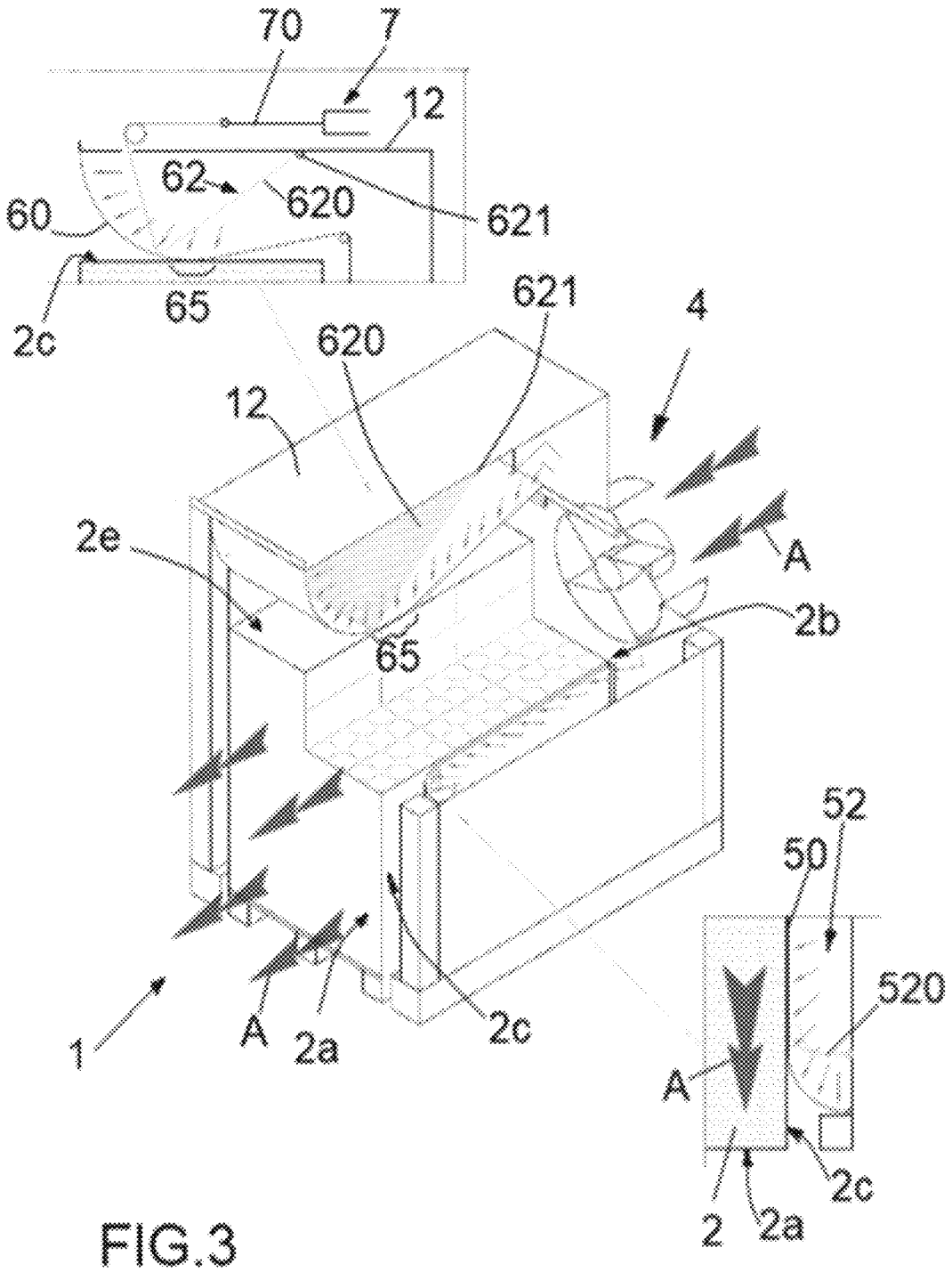
FIG. 3 shows the cell in FIG. 1 during a second phase of operation.
Figure 4:
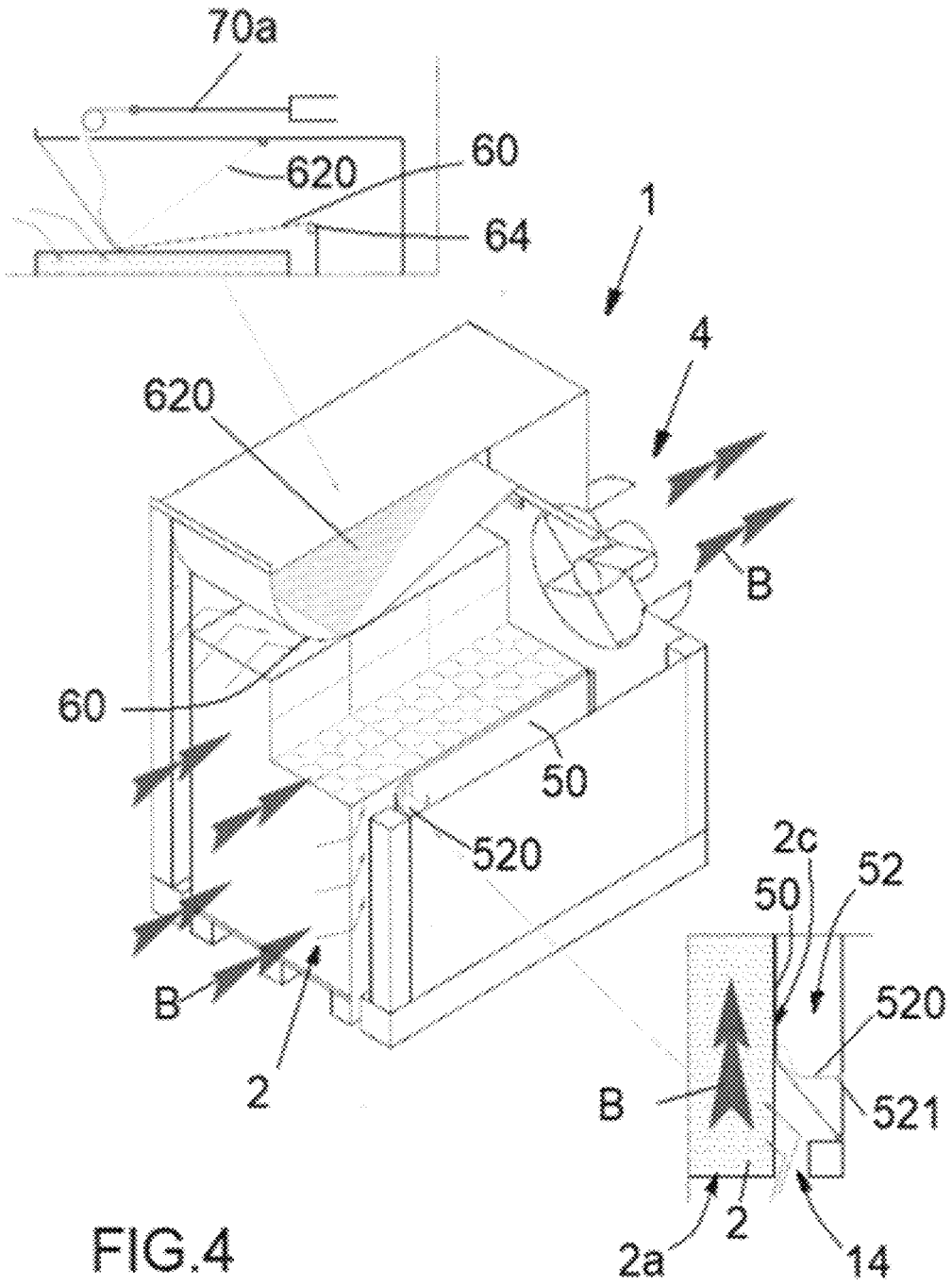
FIG. 4 shows the cell in FIG. 1 in a third phase of operation.

Each side sealing device 5 also has a second sealing element 52, which is movable between an inactive position (FIGS. 1 and 2) and an active position (FIGS. 3 and 4).

More particularly, this second sealing element 52 is not integral with the corresponding side sealing skirt 50.

More particularly, this second sealing element 52 is positioned between the side wall 10 or 11 of the cell to which the side sealing skirt 50 is fixed and the face of the side sealing skirt 50 which is oriented towards said wall 10 or 11.

Preferably this second sealing element 52 of each side sealing device 5 extends in height over at least 50% of the height of the side flexible sealing skirt 50 associated therewith, preferably over at least 75% of the height of the side flexible sealing skirt 50 associated therewith, and more preferably over at least the entire height of the side flexible sealing skirt 50 associated therewith.

Preferably this second sealing element 52 of each side sealing device 5 extends in height over at least 50% of the height H of the housing 14 and preferably over at least 75% of the height H of the housing 14.

In the particular variant according to the accompanying figures, this second sealing element 52 has a vertical flap 520, which is fixed to the inner face of the side wall 10, in the vicinity of the front opening of the housing 14, and which is rotatably hinged relative to the side wall 10 or 11 about a vertical axis of rotation 521. This flap can be equipped with a flexible bead 520*a* to avoid damaging the flexible side sealing skirt 50.

This flap 520 can be rotated in relation to the wall 10 or 11 between:

- an inactive position, as shown in FIGS. 1 and 2, in which it is positioned against the side wall 10 or 11 and is not in contact with side sealing skirt 50, and
- an active position, which is illustrated in FIGS. 3 and 4, and in which it is distanced from the side wall and exerts a mechanical pressure on a front part of the side sealing skirt 50, said mechanical pressure being oriented towards the inside of the cell and allowing the side sealing skirt 50 to be distanced from the corresponding said wall 10 or 11 of the cell, so as to keep said front part of the side sealing skirt 50 pressed against the side face 2*c* or 2*d* of the set 2 of products 20.

The upper sealing device 6 also has a second sealing element 62, which is rotatable relative to the upper wall 12 between an inactive upper position, which is shown in FIGS. 1 and 2, and an active lower position, which is shown in FIGS. 3 and 4.

More particularly, this second sealing element 62 is not integral with the upper sealing skirt 60.

More particularly this second sealing element 62 is positioned between the upper wall 12 of the cell to which the upper sealing skirt 60 is fixed and the upper face of the upper sealing skirt 60 which is oriented towards this upper wall 12.

Preferably, this second sealing element 62 of the upper sealing device 6 extends in width over at least 50% of the width of the first upper flexible sealing element 60 (upper sealing skirt 60) associated therewith and preferably over at least 75% of the width of the first upper flexible sealing element 60 associated therewith.

Preferably this second sealing element 62 of the upper sealing device 6 extends in width over at least 50% of the width L of the housing 14 of the cell 1 and preferably over at least 75% of the width L of the housing 14 of the cell.

In the particular variant of the accompanying figures, this second sealing element 62 has a flap 620, which is attached to the inner face of the upper wall 12, in the vicinity of or at the front opening of the housing 14, and which is rotatably hinged relative to the upper wall 12 about a horizontal axis of rotation 621. This flap 620 is rotatable relative to the upper wall 12 between an inactive position, illustrated in FIGS. 1 and 2, in which it is not in contact with the sealing skirt 60, and an active position, which is illustrated in FIGS. 3 and 4, and in which it exerts on a front part of the sealing skirt 60 a mechanical pressure which is oriented towards the inside of the cell and downwards, so as to keep said front part of the sealing skirt 60 applied against the upper face 2*e* of the set 2 of products 20.

This flap 620 can be fitted with a protective bead at the front (not shown) to prevent damage to the flexible upper sealing skirt 60.

In order to control the pivoting of the sealing flaps 520, 620 from their inactive position to their active position, and vice versa, the storage cell comprises actuating means 7 acting on the flaps 520, 620.

Whatever the embodiment, these actuating means 7 are preferably separate from each flexible sealing element 50 or 60 and therefore do not include each flexible sealing element 50 or 60.

Figure 5:
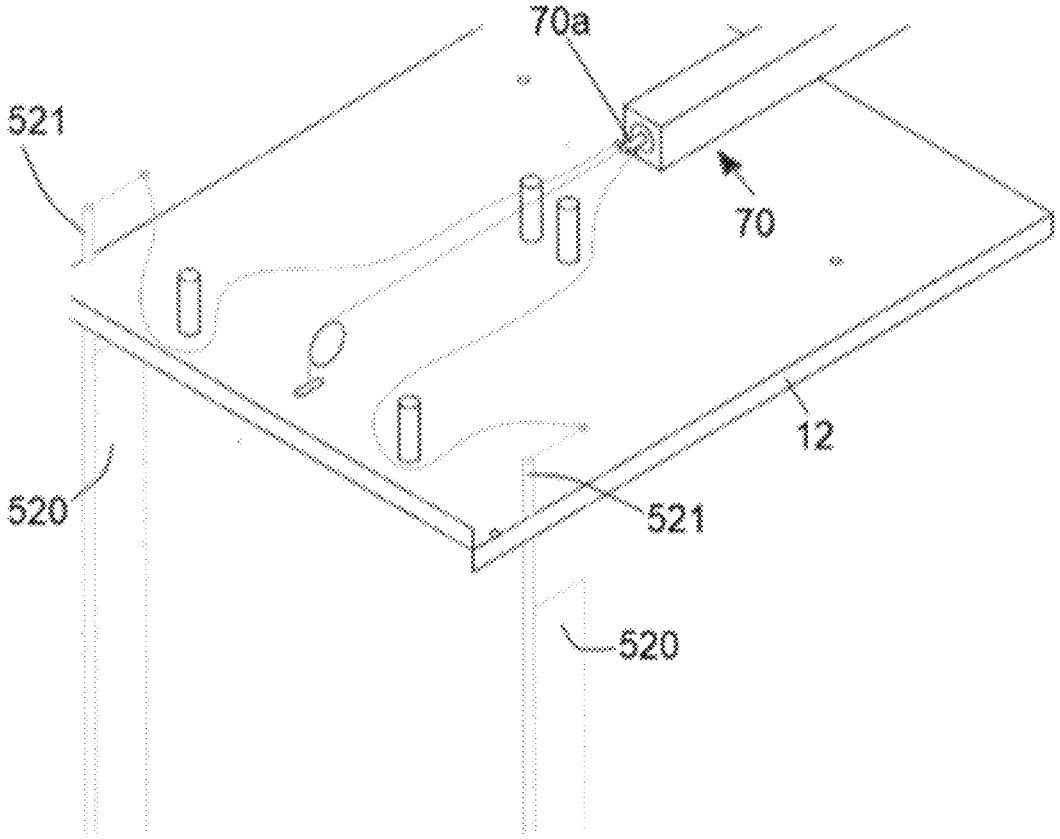
FIG. 5 shows a particular exemplary embodiment of the actuating means of the pivoting flaps of the three storage cell sealing devices in FIG. 1, these flaps being in their inactive configuration, positioned respectively against the inner faces of the two side walls and the upper wall of the storage cell in FIG. 1, and the flexible sealing elements (sealing tarpaulins or equivalent) associated with these flaps not being shown in this figure.
Figure 6:
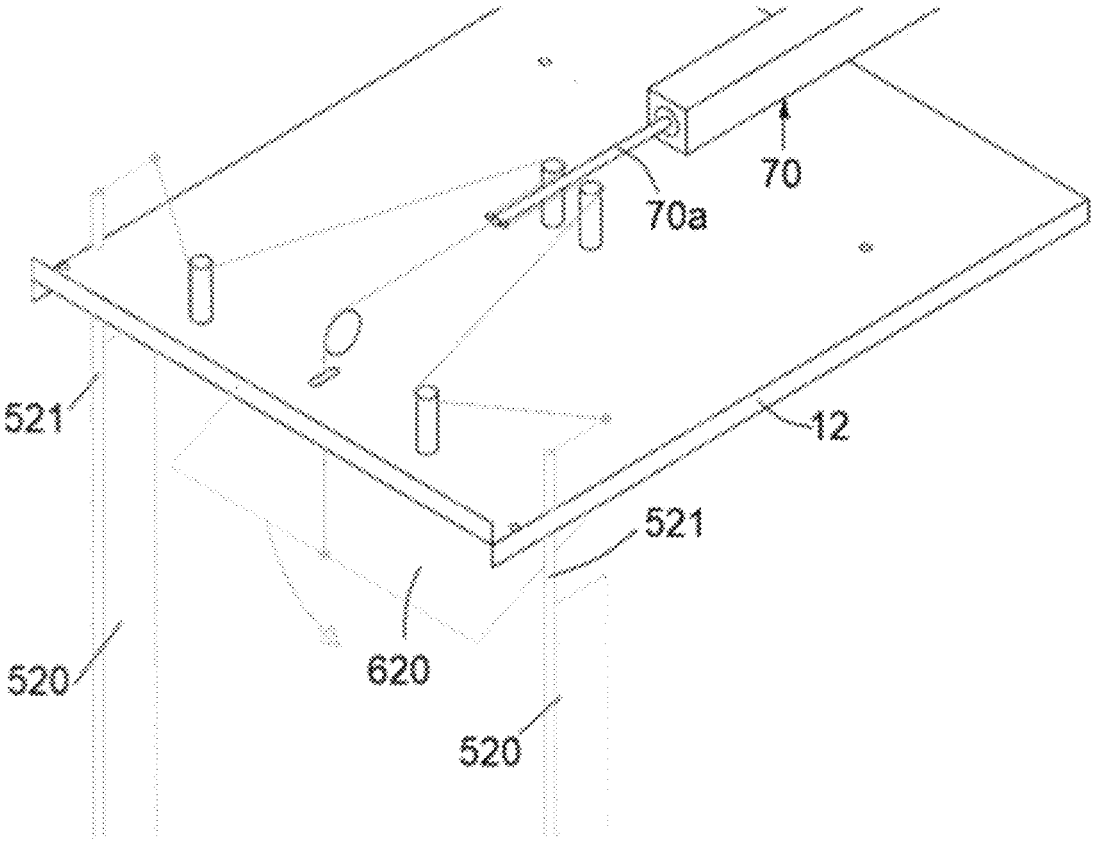
FIG. 6 shows said actuating means of FIG. 5 in a first actuating step allowing the upper sealing flap to be lowered to its active position towards the inside of the cell.
Figure 7:
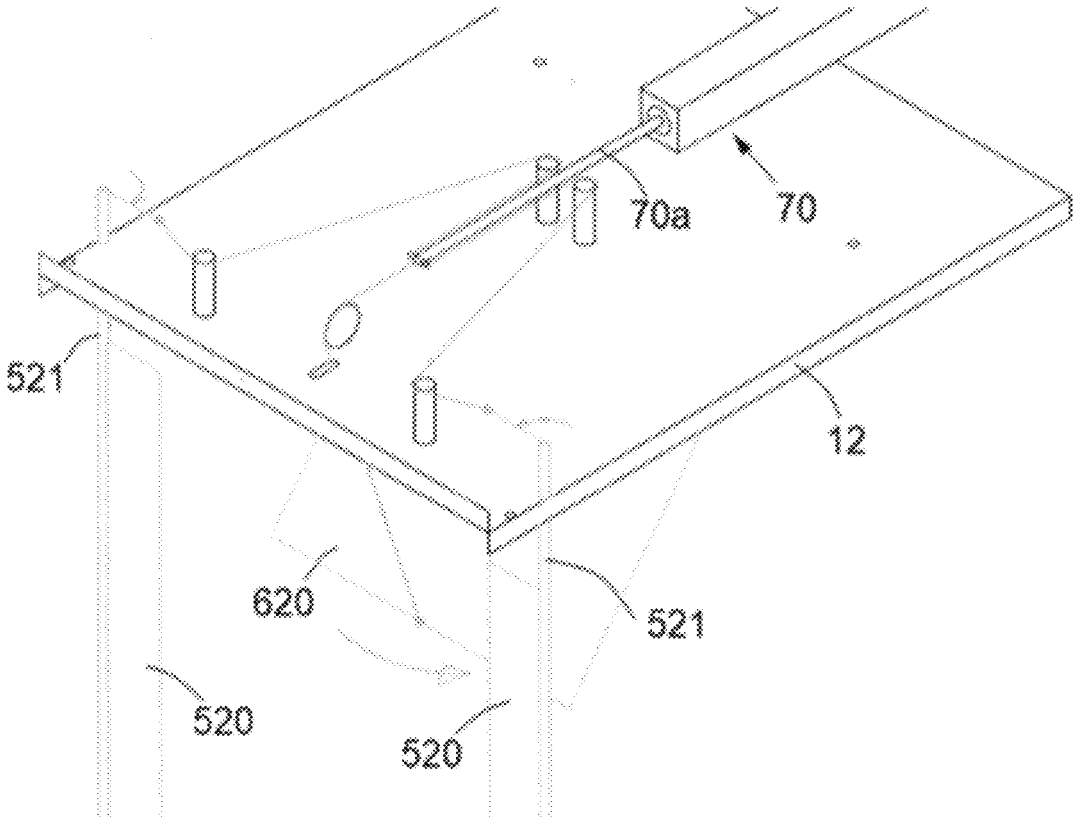
FIG. 7 shows said actuating means of FIG. 5 in a second actuating step making it possible to complete the descent of the upper sealing flap in the active position and making it possible to deploy the two side sealing flaps in their active position towards the inside of the cell.

An example of actuating means 7, to which the invention is not limited, is shown schematically in FIGS. 5 to 7.

In this particular example in FIGS. 5 to 7, these actuating means 7 comprise a bidirectional linear cylinder 70, of which the rod 70*a* is connected by transmission mechanisms:

at the front part of the upper sealing flap 620 (FIG. 6), so as to exert on this upper flap 62 a vertical traction making it possible to control its descent (FIG. 6) until its active position is reached (FIG. 7) by controlling the extension of the rod 70*a* of the cylinder 70, or, conversely, a vertical traction making it possible to raise the upper flap 620 into the inactive position by retracting the rod 70*a* of the cylinder 70 (FIGS. 1 and 5), at each axis of rotation 521 of the two side sealing flaps 520 so as to simultaneously rotate these flaps 520 into their active position (FIGS. 3, 4 and 7) by controlling the extension of the rod 70*a* of the cylinder 70, or, conversely, so as to simultaneously rotate these flaps 520 into their inactive position (FIGS. 1, 2 and 5) by controlling the retraction of the rod 70*a* of the cylinder 70.

Specific examples of the realization and operation of the storage cell, to which the invention is not limited, will now be detailed.

The storage cell 1 also comprises electronic means for automatic cell control, which electronic means are capable of automatically controlling the ventilation means 4 and the actuating means 7 of the second sealing elements 52, 62. These electronic means for automatic cell control are, for example, implemented in the form of a programmable logic controller, which is capable of automatically executing a program stored in a memory.

Specific examples of operating cycles that can be automatically controlled by the electronic means for automatic cell control will now be detailed.

With reference to FIG. 1, the ventilation means 4 are stopped and the storage cell is in a loading (or unloading) configuration. The side sealing skirts 50 are not inflated and the upper sealing skirt 60 is not inflated and is stretched towards the rear by the counterweight 61. The rod 70*a* of the cylinder 70 is retracted (FIG. 5), such that the side sealing flaps 520 are in the inactive position (FIG. 1), positioned against the side walls 10 and 11 respectively, and do not apply mechanical pressure to the side sealing skirts 50, and the upper sealing flap 620 is in the inactive position (FIG. 1), positioned against the upper wall 12 and does not apply mechanical pressure to the upper sealing skirt 60. The set 2 of products 20 packed on a carrier 3 of the pallet type is positioned in the storage cell.

With reference to FIG. 2, in a first phase, the electronic means for automatic cell control activate the ventilation means 4, so that a rear-to-front air flow A is circulated in the cell from the rear towards the front of the cell.

The air pressure that is generated by this rear-to-front flow inside the storage cell between each skirt 50, 60 and the corresponding wall 10, 11 or 12 allows the inflation in the sealing configuration of the sealing skirts 50, 60 in relation to their respective walls 10, 11 and 12, so that, with reference to FIG. 2:

the upper sealing skirt 60 inflates towards the inside of the cell by partially abutting the upper face 2*e* of the set 2 of products 20, so as to provide a seal with respect to the upper wall 12 in the contact area 65 (FIG. 2) between the upper sealing skirt 60 and the upper face 2*e* of the set 2 of products 20.

each side skirt 50 inflates towards the inside of the cell by pressing over substantially its entire surface against the corresponding side face 2*c* or 2*d* of the set 2 of products 20, so as to provide a seal with respect to the side wall 10 or 11 in the contact zone 55 between the side sealing skirt 50 and the side face 2*c* or 2*d* of the set 2 of products 20.

A seal is thus created on all three faces (upper face 2*e* and side faces 2*c* and 2*d*) of the set 2 of products 20, so that the rear-to-front air flow A entering the cell is channeled so that it flows from the rear to the front, through the products 20 in the set 2.

During this first phase of inflation of the sealing skirts 50, 60, the sealing flaps 520 and 620 are preferably, but not necessarily, retracted against the walls 10, 11, and 12 (inactive position), and do not interfere with the inflation of the sealing skirts 50, 60.

In this first phase, the inflation of the sealing skirts 50, 60 can take place simultaneously or successively, for example with inflation first of the upper sealing skirt 60, and then inflation of the side sealing skirts 50. With reference to FIG. 3, in a second phase, the electronic means for automatic cell control automatically control the actuating means 7 of the flaps 520 and 620 so as to swivel them into the active position, in which:

each side flap 520 exerts a mechanical pressure on a front part of the corresponding side sealing skirt 50, said mechanical pressure being oriented towards the inside of the cell and in a direction opposite said side wall 10 or 11 of the cell in relation to which the side sealing skirt 50 is inflatable; this mechanical pressure makes it possible to distance the side sealing skirt 50 from said side wall 10 or 11 of the cell and thus to keep said front part of the sealing skirt 50 applied against the side face 2*c* or 2*d* of the set 2 of products 20, the upper flap 620 exerts, on a front part of the upper sealing skirt 60, a mechanical pressure oriented towards the inside of the cell and in a direction opposite the upper wall 12 of the cell (downwards); this mechanical pressure makes it possible to distance the upper sealing skirt 60 from said upper wall 12 and to keep said front part of the sealing skirt 60 applied against the upper face 2*e* of the set 2 of products 20.

During this second phase, the active operation of the flaps 520 and 620 can be performed simultaneously or successively, for example with operation first of the upper flap 620, and then operation of the side flaps 520.

These mechanical pressures exerted on the sealing skirts 50 and 60 improve the seal, and in this embodiment the sealing skirts 50 and 60 are kept in contact with the set 2 of products 20 at the maximum towards the front of this set 2 of products 20. In addition, in the event of an accidental drop in the flow rate of the fan 40 or an unintentional stop of the fan 40 for a longer or shorter period of time, each sealing tarpaulin 50, 60 is kept in constant contact with the set 2 of products 20, and in this particular embodiment, in particular, the counterweight 61 is prevented from accidentally pulling the upper sealing tarpaulin 62 backwards.

The first and second phases can be carried out successively in any order (first phase then second phase, or conversely, second phase then first phase) or possibly can be carried out simultaneously. It is preferred, however, that the second phase is carried out after the first phase.

Nevertheless, at the end of the first phase and the second phase, the products 20 in the front part of the set 2, which are located between the loading opening of the cell and the contact zones 55, 65 of the sealing skirts 50 and 60 with the set 2 of products 20, may present a lack of homogeneity with regard to temperature and/or humidity as compared to the other products 20 in the set 2.

To overcome this problem, with reference to FIG. 4, in a third phase, the electronic automatic control means of the cell automatically control the ventilation means 4 so as to stop the rear-to-front air flow A and to create a reverse air flow B, which flows through the set 2 of products 20 from the front to the rear of the cell and the temperature and/or humidity of which are preferably adjusted as for the rear-to-front air flow A.

This reversal of the air flow direction is made possible by the fact that the sealing skirts are held, by the actuating means 7, in contact with the set 2 of products 20 by sealing flaps 520 and 620 in their active position in FIGS. 3 and 4.

At the entry to the cell 1, this reverse air flow B is channeled so as to pass through at least all the products 20 in the front part of the set 2, which are located between the cell loading opening and the contact areas 55, 65 of the sealing skirts 50 and 60 with the set 2 of products.

Where appropriate, this reverse air flow B may improve the homogeneity of the temperature and/or humidity of the products 20 in the set 2, and may allow a reduction in the duration of the cell's operating cycles.

More particularly, the automatic cell control means can also be programmed to automatically control the ventilation means 4 so as to implement at least a fourth phase, during which they control the ventilation means 4 so as to stop the front-to-rear air flow B and create a reverse rear-to-front air flow A, the sequence of the third phase and fourth phase possibly being repeatable several times.

Although the implementation of a reverse air flow B is preferable within the scope of a preferential implementation of the storage cell according to the invention, it is, however, not necessary. In fact, in another variant, the above-mentioned third phase could consist in continuing to operate the ventilation means 4, in such a way as to maintain, for a given period of time, the rear-to-front air flow A circulating through the products 20 from the rear to the front of the cell.

More particularly, within the scope of this other variant, the automatic cell control means can also be programmed to automatically control the ventilation means 4 so as to implement at least a fourth phase, during which they control the ventilation means 4 so as to stop the rear-to-front air flow A and create a reverse front-to-rear air flow B, and possibly a fifth phase, during which they control the ventilation means 4 so as to stop the front-to-rear air flow B and create a reverse rear-to-front air flow A, the sequence of the fourth and fifth phases possibly being repeatable several times.

In another embodiment of the method, the second sealing elements 52 and 62 (flaps 520 and 620) can only be brought into an active configuration during the operating phase in which a front-to-rear air flow B, which does not allow the side sealing skirts 50 and upper sealing skirt 60 to be inflated, is created in the storage cell.

Preferably before unloading the storage cell by removing the set 2 of products 20, the fan 40 is stopped and the actuating means 7 are used to actuate the second sealing elements 52 and 62 to the inactive position so as to facilitate the unloading of the products 20. The invention is not limited to the particular exemplary embodiments of a storage cell which have been previously described with reference to the accompanying figures, and other embodiments may also be envisaged within the scope of the invention. Thus, in a non-exhaustive manner, in other embodiments:

- the storage cell may comprise a single sealing device according to the invention, for example only on the top or on one of the sides of the set 2 of products, the sealing on the other sides being able to be provided by using other conventional and known sealing means;
- the storage cell may comprise only two sealing devices according to the invention for sealing only at the top 2e and on one of the sides 2*c* or 2*d* of the set of products, the sealing on the other side 2*d* or 2*c* being able to be provided by using other conventional and known sealing means;
- the storage cell may comprise only two sealing devices according to the invention for sealing only on the two sides 2*c* and 2*d* of the set of products, the sealing on the top 2e being able to be provided by using other conventional and known sealing means.

In addition, the actuating means 7 for the flaps 520 and 620 are not limited to those shown in FIGS. 5 to 7.

It is also possible, although not exhaustive, to use flaps 520 or 620 which are equipped with elastic return means, of the spring type, making it possible, in the absence of mechanical stress on the flap 520 or 620, to return it to the active position or, on the contrary in another variant, to return it to the inactive position.

In another variant, a flap 520 or 620 can be replaced by any means which can be controlled so as to be configured in an active position, in which it exerts a mechanical pressure on a front part of the flexible sealing skirt or equivalent 52, 62, said mechanical pressure being oriented towards the inside of the cell independently of the air flow (A or B) circulated in the cell, and an inactive position, in which it no longer exerts this mechanical pressure. For example, a rotary sealing flap 520 or 620 can be replaced by a sealing flap which can be moved in translation between its inactive and active positions.

The invention is not limited to the use of a cylinder for actuating the sealing flaps 520, 620 or equivalent. In another variant, the cylinder may be replaced by one or more motors. It is also possible to use axes of rotation 521, 621, which are magnetically controlled to set the flaps 520, 620 in rotation. In addition, the actuating means for the flaps can be independent of each other and allow, in particular, simultaneous or sequential actuation of the sealing flaps.

Figure 10:
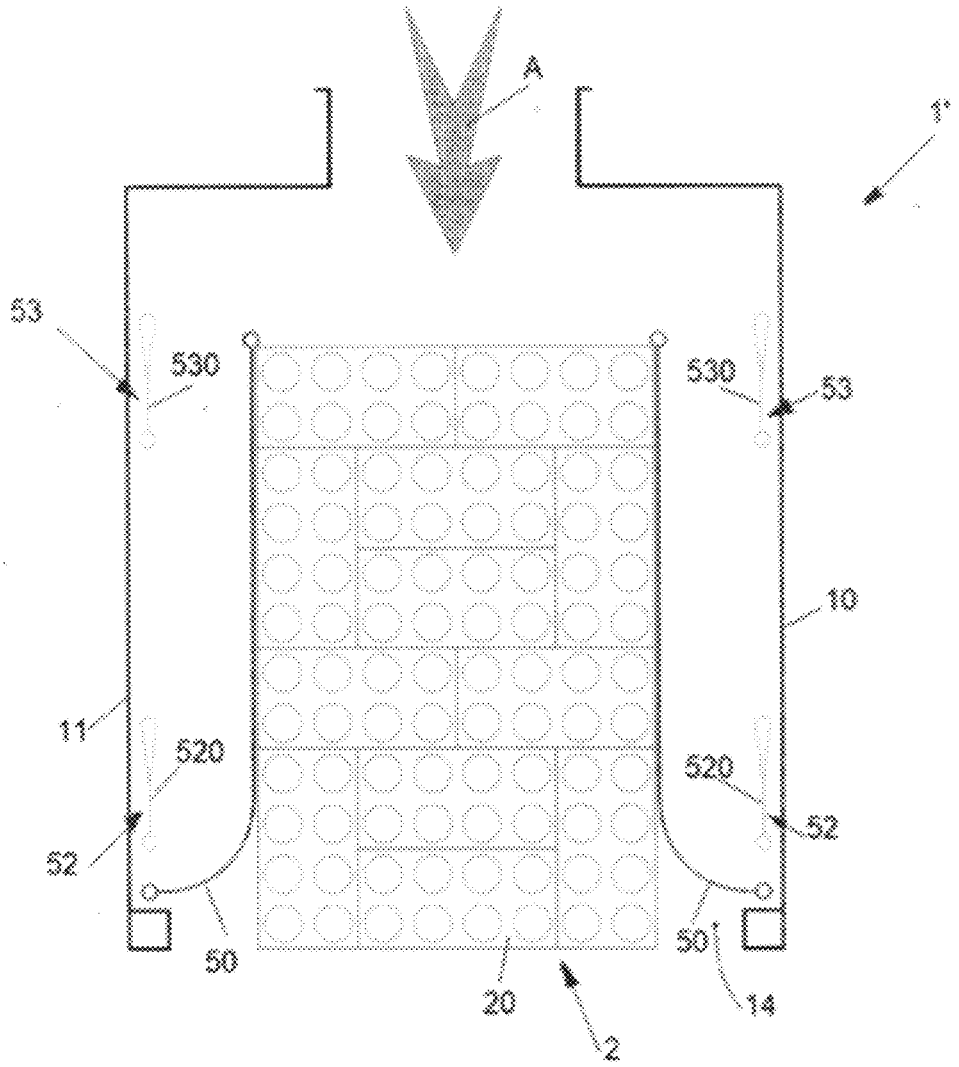
FIG. 10 is a sectional view of a second embodiment of a cell of the invention, the side tarpaulins being inflated and the sealing elements being in an inactive position.
Figure 11:
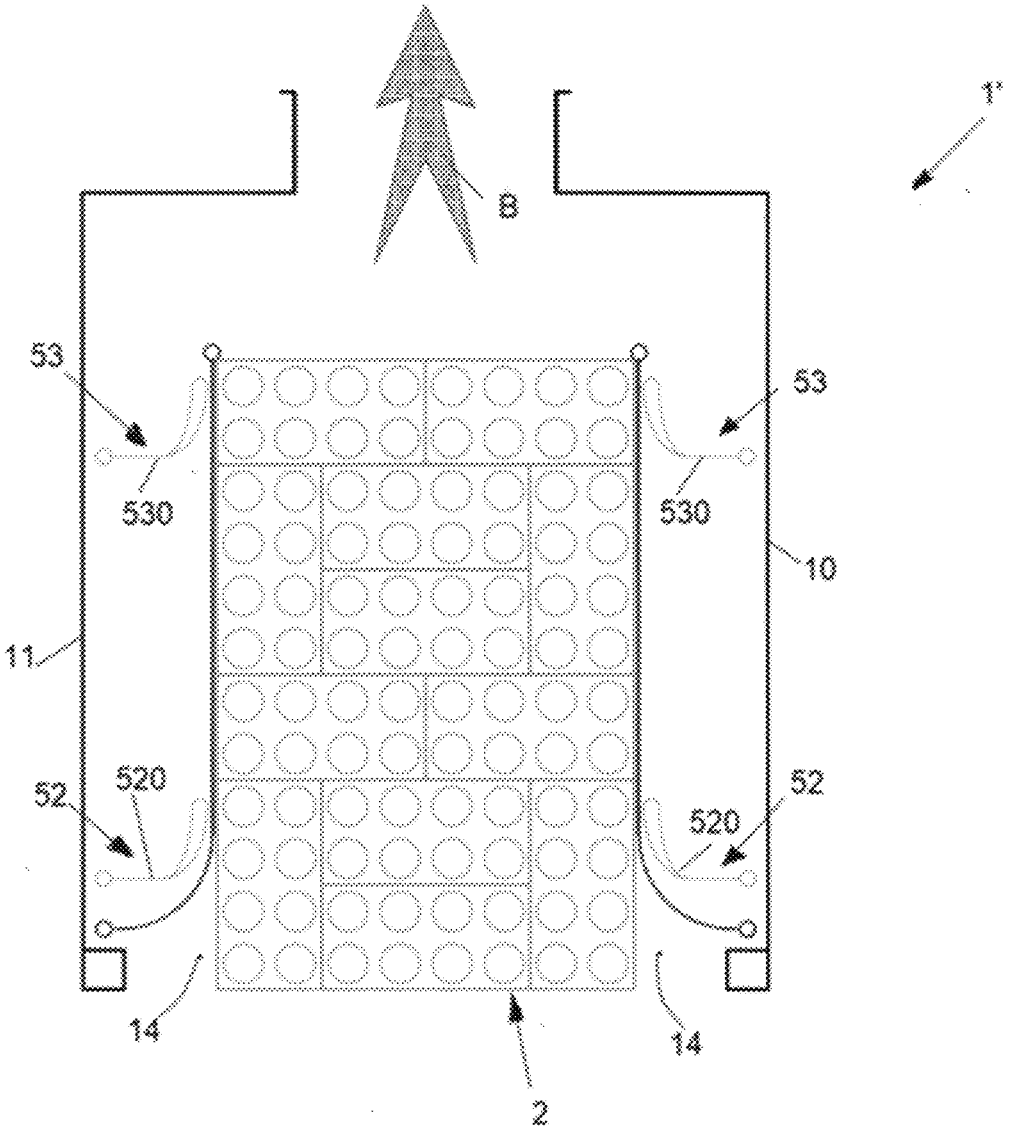
FIG. 11 is a sectional view of the cell in FIG. 10, the side tarpaulins being inflated and the sealing elements being in an active position.

FIGS. 10 and 11 show another embodiment of a cell 1', in which each side sealing device 5 has, at the rear, an additional sealing element 53, in the form of a rotary flap 530, which, in the active position, makes it possible to exert a pressure on a rear part of the corresponding side tarpaulin 50.

Figure 12:
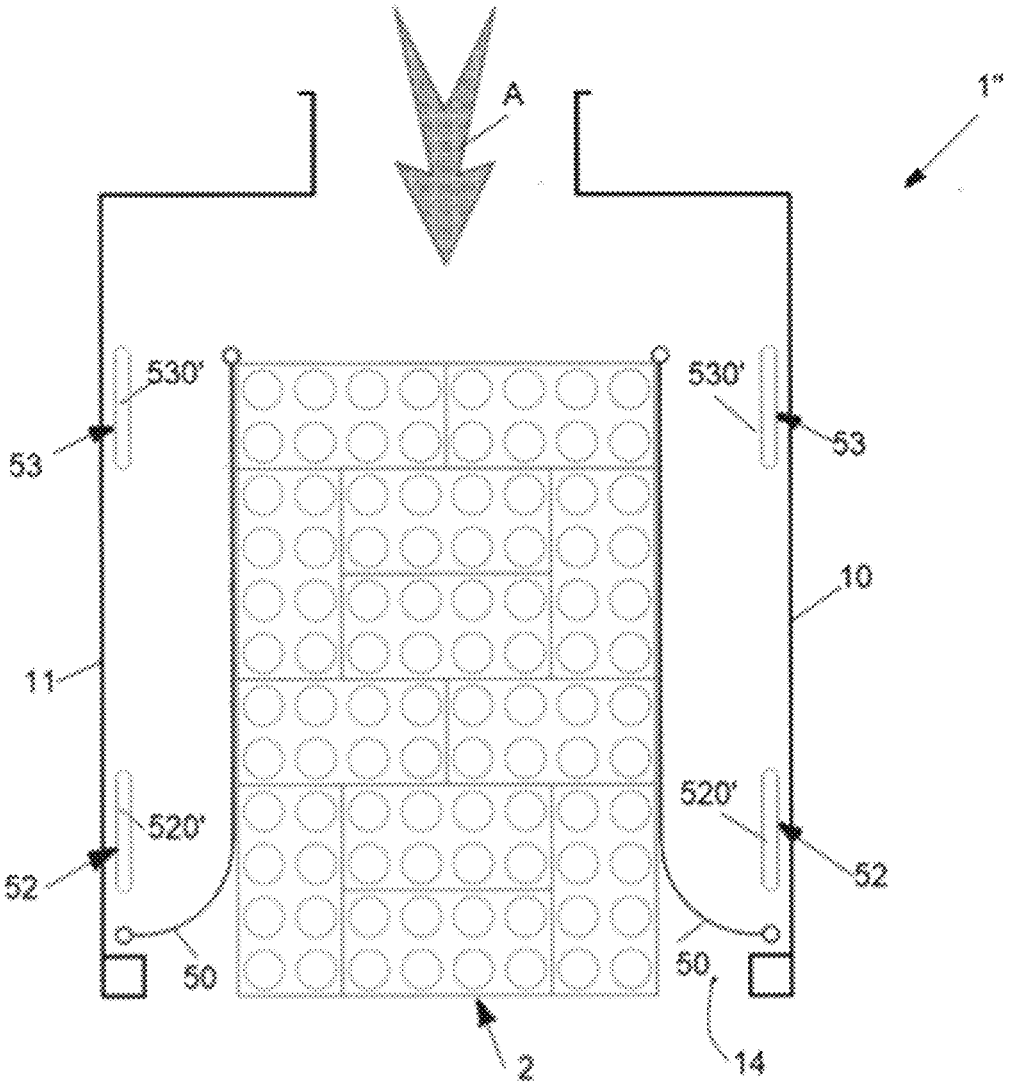
FIG. 12 is a sectional view of a third embodiment of a cell of the invention with inflatable sealing elements, the side tarpaulins being inflated and the inflatable sealing elements being deflated.
Figure 13:
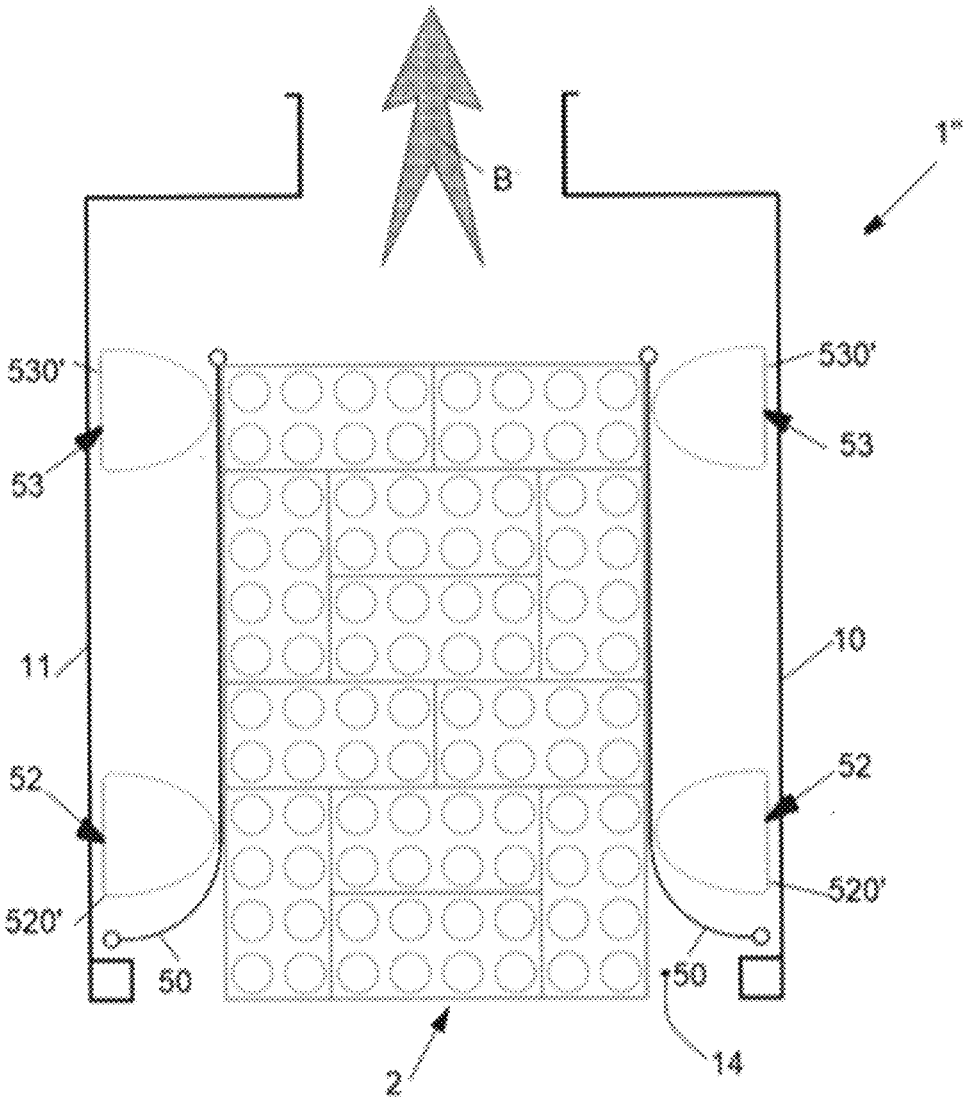
FIG. 13 is a sectional view of the embodiment of the cell in FIG. 12, with the side tarpaulins inflated and the inflatable sealing elements inflated.

FIGS. 12 and 13 show an alternative embodiment of a cell 1 ", in which the rotary sealing flaps 520 and 530 of the variant in FIGS. 10 and 11 have been replaced by inflatable elements 520' and 530', of the inflatable bag type, which are interposed between the corresponding flexible sealing skirt 50 and the corresponding wall 10, 11 of the cell, and, in the inflated state (FIG. 13), make it possible for said mechanical pressure to be exerted on the sealing skirt 50 (active configuration), and which, in the deflated state (FIG. 12), make it possible for no further mechanical pressure to be exerted on the sealing skirt 50 (inactive configuration). In this case the actuating means 7 are means for inflating/deflating this inflatable sealing element.

In another variant, the cell 1" in FIGS. 12 and 13 could be without the rear inflatable bags 530'.

The air for inflating the inflatable elements 520' and 530', of the inflatable bag type, may be obtained by means of an air source (fan or air compressor) which is independent of the ventilation means 4, or may be obtained by recycling or diverting part of the air flow produced by the ventilation means 4.

In another embodiment, the ventilation means 4 may be designed or used in such a way as to create only one air flow (rear-to-front A or front-to-rear B) allowing the inflation of the sealing tarpaulins 50, 60 or equivalent (i.e. no creation of a reverse air flow).

The ventilation means 4 are not necessarily positioned at the rear wall 13 of the cell. In other embodiment, these ventilation means 4 may also be positioned at the rear of the cell on the upper wall 12 or at least one of the side walls 10 or 11 of the cell.

Figure 14:
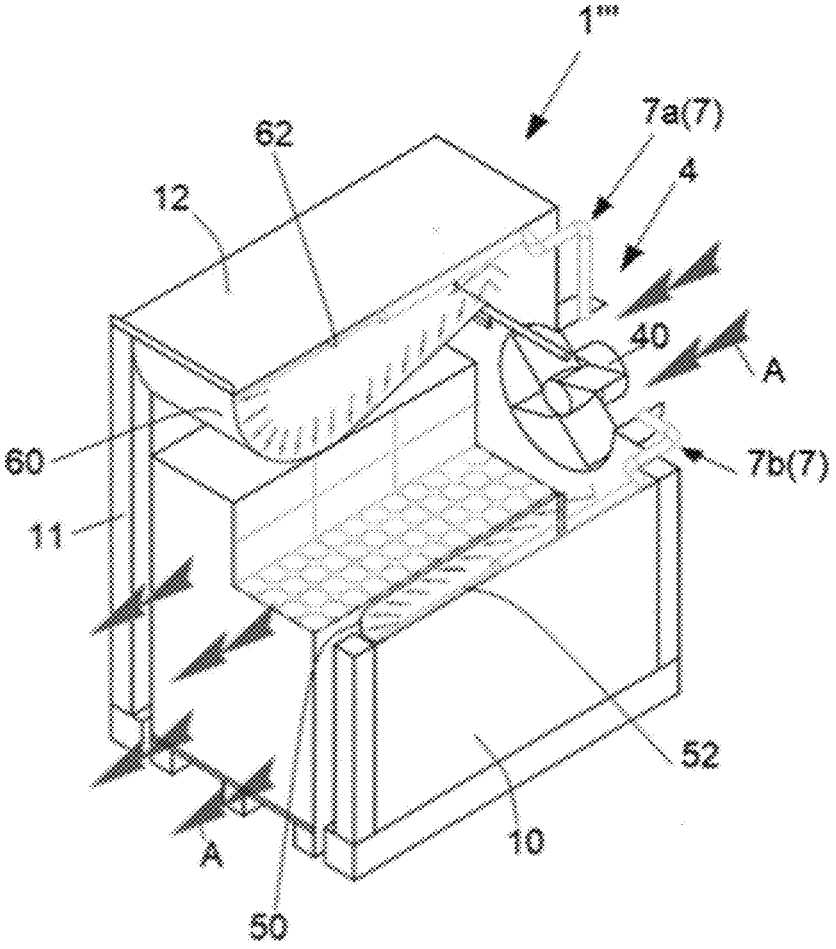
FIG. 14 is an isometric overview of a fourth embodiment of a cell of the invention, with inflatable sealing elements, during an operating phase in which the side and upper sealing tarpaulins are inflated by a rear-to-front air flow and the inflatable sealing elements are deflated.
Figure 15:
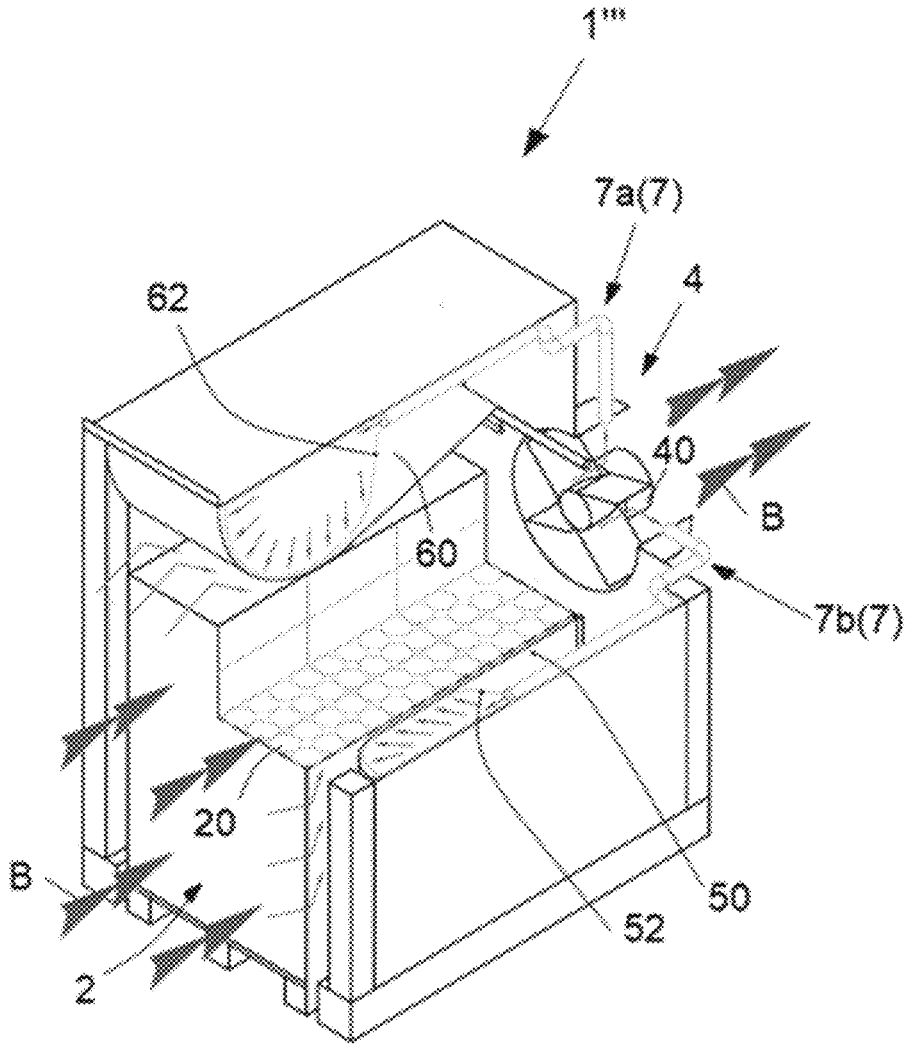
FIG. 15 is an isometric overview of the cell in FIG. 13, during another operating phase in which the air flow has been reversed (front-to-rear air flow), the side and upper sealing tarpaulins are deflated and the inflatable sealing elements are inflated using part of the front-to-rear air flow.

FIGS. 14 and 15 show a further variant for producing a storage cell 1''', in which the actuating means 7 of the side inflatable elements 52 and upper inflatable element 62 (forming the second sealing elements) comprise return air pipes 7*a* and 7*b*, which allow a part of the front-to-rear air flow B (FIG. 15) to be sucked into these side inflatable elements 52 and upper inflatable element 62, so as to inflate them when the ventilation means 4 circulate a front-to-rear air flow B through the cell, and allow the air contained in these side inflatable elements 52 and upper inflatable element 62 to be sucked out when the ventilating means 4 circulate a rear-to-front air flow A through the cell (FIG. 14) so as to deflate them.

With reference to FIG. 14, during an operating phase, the ventilation means 4 create, by blowing, a rear-to-front air flow A in the cell, which in particular makes it possible to inflate the side sealing skirts 50 and upper sealing skirt 60. Under the effect of this rear-to-front air flow A, the tubes 7*a* and 7*b* allow the air contained in the side inflatable elements 52 and upper inflatable element 62 to be sucked out, thus deflating them or keeping them deflated.

With reference to FIG. 15, in another operating phase, the ventilation means 4 create a reverse, front-to-rear air flow B in the cell by suction, and the tubes 7*a* and 7*b* make it possible for part of this front-to-rear air flow B to be sucked up and blown into the side inflatable elements 52 and upper inflatable element 62.

In this variant, the storage cell comprises automatic control means, which are configured to control the ventilation means 4, so as to create the rear-to-front air flow A or the reverse, front-to-rear air flow B and thus automatically implement one or other of the two aforementioned operating phases.

In a preferred embodiment, these automatic control means are capable of controlling the ventilation means 4, so as to create, alternately, the rear-to-front air flow A and the reverse, front-to-rear air flow B, and thus automatically implement at least the two above-mentioned operating phases, the order of these operating phases being unimportant.

The invention claimed is:

1. A storage cell for storing at least one set of products, said storage cell comprising:

first and second side walls facing each other and spaced apart from each other and an upper wall delimiting, with the first and second side walls, a housing for the set of products, said housing comprising a front face an opening on the front face for introduction and/or removal of the set of products;

a ventilation device, which is capable of creating a first air flow and a reverse second air flow, the first air flow circulating in the housing from a rear of the housing towards a front of the housing or from the front of the housing towards the rear of the housing, and the reverse second air flow respectively circulating in the housing from the front of the housing towards the rear of the housing or from the rear of the housing towards the front of the housing;

at least one sealing device comprising a first flexible sealing element, which is inflatable in relation to at least one of the walls of the cell and towards an inside of the housing under an effect of an air pressure which is generated in the housing by said first air flow created by the ventilation device, wherein said at least one sealing device comprises at least one second sealing element, which is actuatable between an inactive configuration and an active configuration in which the at least one second sealing element exerts a mechanical pressure on part of the first flexible sealing element, said mechanical pressure being oriented towards the inside of the housing and allowing said first flexible sealing element to be distanced from said wall of the cell in relation to which said first flexible sealing element is inflatable; and an actuating system which actuates the second sealing element in the active configuration at least when the ventilation device creates the reverse second air flow.

2. The storage cell according to claim 1, wherein the second sealing element is movable between the inactive configuration and the active configuration.

3. The storage cell according to claim 1, wherein the second sealing element is an inflatable element which, when inflated, exerts the mechanical pressure on part of the first flexible sealing element.

4. The storage cell according to claim 1, wherein the at least one sealing device comprises at least one first side sealing device and at least one second side sealing device, wherein said first side sealing device comprises a respective first flexible side sealing element, which, under the effect of the air pressure, is inflatable in relation to one of the first or second side walls of the cell and towards the inside of the housing, and a respective at least one second sealing element that can be actuated between the inactive configuration and the active configuration in which the respective second sealing element exerts a respective mechanical pressure on part of the respective first flexible side sealing element of the first side sealing device, said respective mechanical pressure being oriented towards the inside of the housing and allowing said respective first flexible side sealing element to be distanced from said first or second side wall of the cell in relation to which said respective first flexible sealing element is inflatable, and wherein said second side sealing device comprises a respective first flexible side sealing element, which, under the effect of the air pressure, is inflatable in relation to the other of the first or second side wall of the cell and towards the inside of the housing, and at least one respective second sealing element that can be actuated between the inactive configuration and the active configuration in which the respective second sealing element exerts a respective mechanical pressure on part of the respective first flexible side sealing element of the second side sealing device, said respective mechanical pressure being oriented towards the inside of the housing and allowing said respective first flexible side sealing element to be distanced from said other of the first or second side wall of the cell in relation to which said respective first flexible sealing element is inflatable.

5. The storage cell according to claim 4, wherein the at least one sealing device further comprises an upper sealing device which comprises a respective first flexible upper sealing element which, under the effect of the air pressure, is inflatable in relation to the upper wall of the cell and towards the inside of the housing and a respective second sealing element, which can be actuated between the inactive configuration and the active configuration in which the respective second sealing element exerts a respective mechanical pressure on a portion part of the first flexible upper sealing element, said respective mechanical pressure being oriented towards the inside of the housing and downwards and allowing said first flexible upper sealing element to be distanced from said upper wall.

6. The storage cell according to claim 1, wherein the at least one sealing device comprises at least one side sealing device and an upper sealing device, wherein said side sealing device comprises a respective first flexible side sealing element, which, under the effect of the air pressure, is inflatable in relation to one of the first or second side walls of the cell and towards the inside of the housing, and at least one respective second sealing element that can be actuated between the inactive configuration and the active configuration, in which the respective second sealing element exerts a respective mechanical pressure on part of the respective first flexible side sealing element of the side sealing device, said respective mechanical pressure being oriented towards the inside of the housing and allowing said respective first flexible side sealing element to be distanced from said first or second side wall of the cell in relation to which said respective first flexible sealing element is inflatable, and wherein said upper sealing device comprises a respective first flexible upper sealing element, which, under the effect of the air pressure, is inflatable in relation to the upper wall of the cell and towards the inside of the housing, and a respective second sealing element that can be actuated between the inactive configuration and the active configuration in which the respective second sealing element exerts a respective mechanical pressure on part of the respective first flexible upper sealing element of the upper sealing device, said respective mechanical pressure being oriented towards the inside of the housing and downwards and allowing said respective first flexible upper sealing element to be distanced from said upper wall.

7. The storage cell according to claim 1, wherein the ventilation device is configured to create, non-concurrently and one after the other, said first air flow and said second reverse air flow, or vice versa.

8. The storage cell according to claim 1, wherein each second sealing element is positioned between said wall of the cell in relation to which said first flexible sealing element is inflatable and a face of the first flexible sealing element oriented towards that wall.

9. The storage cell according to claim 1, wherein each second sealing element is not integral with the first flexible sealing element.

10. The storage cell according to claim 1, wherein each first flexible sealing element is integral with the wall in relation to which the first flexible sealing element is inflatable.

11. The storage cell according to claim 1, comprising a control unit which is configured to control the ventilation device and the actuation at least of each second sealing element, such that, during at least one phase of operation of the storage cell, at least each second sealing is in the active configuration and the ventilation device generates, in the housing, said reverse second air flow which does not inflate each first flexible sealing element.

12. The storage cell according to claim 11, wherein the control unit is configured to control the ventilation device and the actuation of at least each second sealing element in such a way that, during at least one further operating phase of the storage cell, the ventilation device generate, in the housing, said first air flow which allows at least each first flexible sealing element to be inflated, each second sealing element being in the active configuration or in the inactive configuration.

13. The storage cell according to claim 1, wherein each second sealing element is an inflatable element, which, when inflated by the actuating system, exerts, on part of the first flexible sealing element associated therewith, said mechanical pressure oriented towards the inside of the housing, wherein the actuating system is arranged to suck out the air contained in each second inflatable sealing element, thus deflating the second inflatable sealing element or keeping the second inflatable sealing element deflated when the ventilation device circulates said first air flow allowing each first flexible sealing element to be inflated.

14. The storage cell according to claim 1, wherein each second sealing element is an inflatable element, which, when inflated by the actuating system, exerts, on part of the first flexible sealing element associated therewith, said mechanical pressure oriented towards the inside of the housing, wherein the actuating system allow is arranged to blow air into each second inflatable sealing element thus inflating the second inflatable sealing element or keeping the second inflatable sealing element in an inflated state when the ventilation device circulates said reverse second air flow not allowing each first flexible sealing element to be inflated.

15. The storage cell according to claim 1, comprising a control unit for automatically controlling the cell, wherein the control unit is configured to automatically control the ventilation device and the actuation of the or each second sealing element, according to an automatic operating cycle comprising at least the following phases:

first phase: creation of said first air flow, which allows each first flexible sealing element to be inflated in relation to one of the cell walls, second phase: actuation of at least each second sealing element, so as to configure each second sealing element in the active configuration, it being possible to carry out the first and second phases successively in any order or to carry out the first and second phases simultaneously, third phase: stopping of the first air flow and creation of said reverse second air flow.

16. The storage cell according to claim 15, wherein the control unit is configured to automatically control the ventilation device to implement at least a fourth phase, during which the control unit controls the ventilation device so as to stop the first air flow and to create the reverse second air flow.

17. The storage cell according to claim 1, comprising a control unit which is configured to automatically control the ventilation device and the actuation of the or each second sealing element, so as to implement at least one operating phase during which the ventilation device creates said first air flow allowing each first flexible sealing element to be inflated in relation to one of the walls of the cell, each second sealing element being able to be in the active configuration or in the inactive configuration.

18. The storage cell according to claim 1, comprising a control unit which is configured to automatically control the ventilation device and the actuation of at least the or each second sealing element, so as to implement at least one operating phase during which the ventilation device creates said reverse second air flow not allowing each first flexible sealing element to be inflated in relation to one of the walls of the cell, at least each second sealing element being in its the active configuration.

19. A method for storing, and more particularly for adjusting temperature and/or humidity of, the at least one set of products by using the storage cell according to claim 1, wherein the method comprises:

positioning said set of products in the housing of the storage cell, then creating the first air flow, circulating through the set of products from the rear to the front of the housing or circulating through the set of products from the front to the rear of the housing, so as to inflate each first flexible sealing element in relation to the at least one of the walls of the cell towards the inside of the housing so that the at least one first flexible sealing element at least partially bears against a side face or top face of the set of products, and provides a seal with respect to said wall in a contact zone between each first flexible sealing element and the set of products, and actuating each second sealing element into the inactive configuration or into the active configuration in which the second sealing element exerts the mechanical pressure on the corresponding first flexible sealing element, said mechanical pressure being oriented towards the inside of the housing towards the set of products, so as to apply or keep applied at least part of the corresponding first flexible sealing element against the set of products, and creating the reverse second air flow, circulating through the set of products from the front to the rear of the housing or circulating through the set of products from the rear to the front of the housing, said reverse second air flow not inflating each first flexible sealing element, and each second sealing element being in the active configuration in which the second sealing element exerts the mechanical pressure on the corresponding first flexible sealing element, said mechanical pressure being oriented towards the inside of the housing towards the set of products, so as to apply or keep applied at least part of the corresponding first flexible sealing element against the set of products.

20. The storage cell according to claim 16, wherein the control unit is configured to repeat the sequence of the third phase and fourth phase several times.

* * * * *